US005435748A

United States Patent [19]

Abe

[11] Patent Number: 5,435,748

[45] Date of Patent: Jul. 25, 1995

[54] CONNECTOR WITH FITTING DETECTION FUNCTION

[75] Inventor: Yukiyasu Abe, Yokkaichi, Japan

[73] Assignee: Sumitomo Wiring Systems, Ltd., Mie, Japan

[21] Appl. No.: 207,676

[22] Filed: Mar. 9, 1994

[30] Foreign Application Priority Data

Mar. 27, 1993 [JP] Japan ..... 5-092168

[51] Int. Cl.[6] ..... H01R 3/00

[52] U.S. Cl. ..... 439/489; 439/188; 439/372

[58] Field of Search ..... 439/188, 350, 352, 353, 439/372, 358, 488, 489, 490; 200/51.09, 51.1

[56] References Cited

U.S. PATENT DOCUMENTS

| | | | |
|---|---|---|---|
| 4,878,853 | 11/1989 | Yamade et al. | 439/144 |
| 5,061,204 | 10/1991 | Murakami | 439/489 |
| 5,131,865 | 7/1992 | Taguchi et al. | 439/489 |
| 5,151,048 | 9/1992 | Sato | 439/489 X |
| 5,158,473 | 10/1992 | Takahashi et al. | 439/489 X |
| 5,277,608 | 1/1994 | Oda | 439/188 |

FOREIGN PATENT DOCUMENTS

| | | |
|---|---|---|
| 0418790A1 | 3/1991 | European Pat. Off. . |
| 0448084A1 | 9/1991 | European Pat. Off. . |
| 0449239A1 | 10/1991 | European Pat. Off. . |
| 3-190068 | 8/1991 | Japan . |
| 4-334908 | 11/1992 | Japan . |

*Primary Examiner*—Khiem Nguyen
*Attorney, Agent, or Firm*—Oliff & Berridge

[57] ABSTRACT

A connector includes first terminals that are mounted on a vehicle-side housing in a projected manner, and second terminals that are mounted on a power source-side housing. A first contact portion provided at one end of each of the second terminals is so disposed as to be contacted with a respective one of the first terminals, and a first opening/closing switch of a detection circuit is constituted therebetween. A second contact portion provided at the other end of the second terminal is disposed in facing relation to a contact plate affixed to a lower surface of a lock lever, and a second opening/closing switch is constituted therebetween. In a half-fitted condition, the first opening/closing switches are closed, but the second opening/closing switches are open, and therefore, the detection circuit has not yet been closed. When the complete fitting is achieved, a retaining pawl of the lock lever fits in a fitting hole, so that the contact plate is brought into contact with the second contact portions of the second terminals, thereby closing the second opening/closing switches, so that the detection circuit is closed.

17 Claims, 4 Drawing Sheets

CONNECTOR WITH FITTING DETECTION FUNCTION

BACKGROUND OF THE INVENTION

This invention relates to a connector, and more particularly to a connector having an electrical fitting detection function such that an electrical connection providing, for example, electrical charging, can be effected when female and male connector housings are completely fitted together.

There is known a connector of this type having a fitting detection function, wherein when female and male connector housings are fitted together, a retaining pawl is fitted in a fitting hole in a fitting hole-forming plate to lock the housings relative to each other, and the retaining pawl and the fitting hole-forming plate are both made of metal and are connected, as terminals of a detection circuit, directly to a charging path.

In the above construction, however, when the connector is in a half-fitted condition, in which the retaining pawl is not received in the fitting hole but is merely contacted with the fitting hole-forming plate, the detection circuit is closed. If charging is effected in this condition, the retaining pawl jumps off the fitting hole-forming plate during the time when the connector shifts into a completely-fitted condition, so that the two terminals are disengaged from each other, and a fine spark is produced between the two terminals, which results in a possibility that the terminals are deteriorated by oxidation or the like.

In another known detection system disclosed in Japanese Patent Unexamined Publication No. 3-190068, a pin terminal for detection purposes and a reception terminal having a contact portion of a small area for receiving the pin terminal, are provided on side surfaces of two housings. When the housings are completely fitted together, the pin terminal is contacted with the contact portion of the reception terminal, thereby closing a detection circuit. In this construction, a stroke control must be precisely effected. In other words, the mounting position of the pin terminal and the reception terminal must be precisely accurate. Thus, this construction has a drawback in that the manufacturing cost is high.

SUMMARY OF THE INVENTION

A connector according to the present invention has been made to overcome the drawbacks of the conventional connectors. When two connector housings are to be fitted together, lock members are engaged with each other after two terminals are contacted with each other, and the lock members have a contact that is contacted with the terminal to close a detection circuit when the lock members are engaged with each other.

When the two connectors are fitted together, the two terminals are contacted with each other before complete fitting is achieved, that is, in a half-fitted condition, but the contact has not yet been contacted with the terminal, and therefore, the detection circuit is not closed.

When the fitting operation further proceeds, complete fitting is achieved, so that the lock members are engaged with each other whereupon the contact provided on the lock members is brought into contact with the terminal, thereby closing the detection circuit.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

One embodiment of the present invention, in which the invention is applied to a connector for charging an electric car, will now be described with reference to FIGS. 1 to 4(D).

Figure 1:
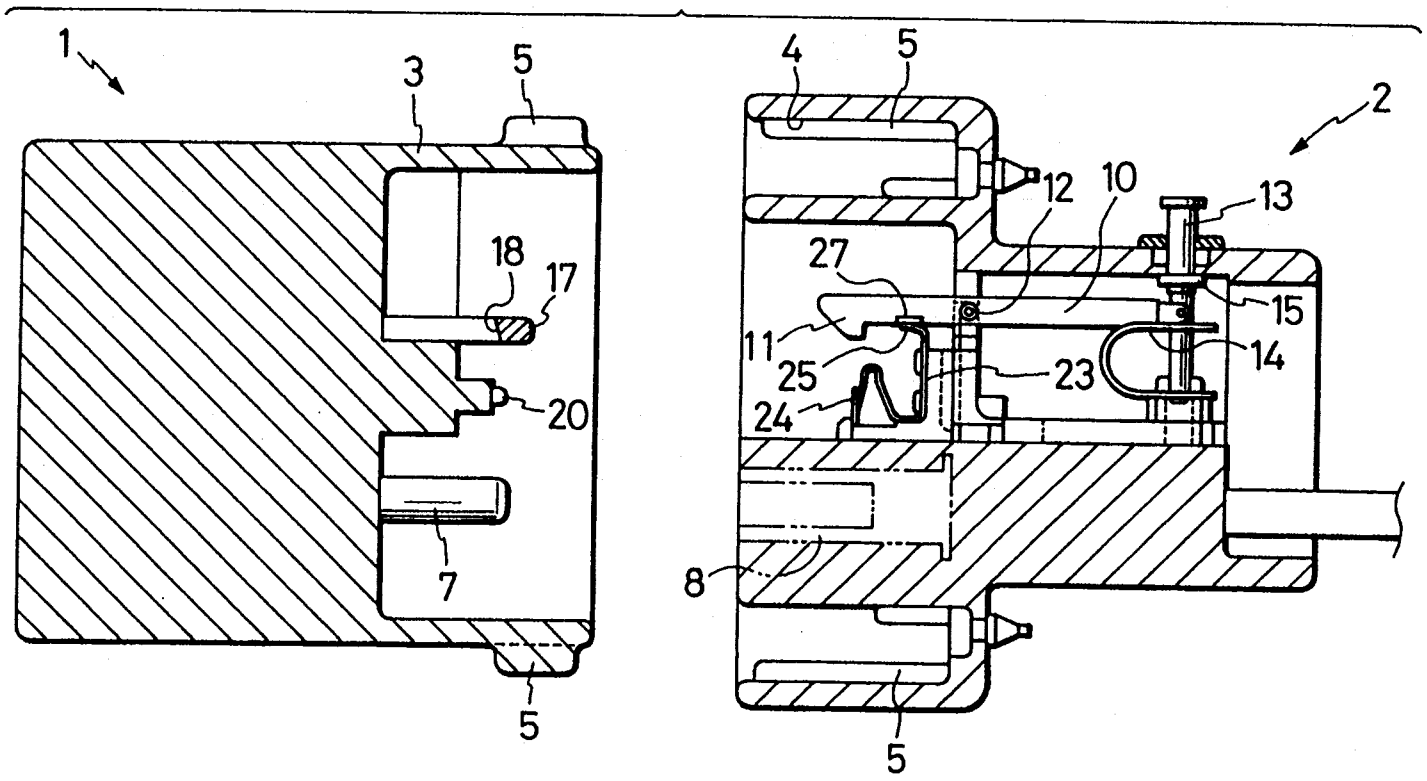
FIG. 1 is a vertical cross-sectional view of one preferred embodiment of the present invention.
Figure 2A:
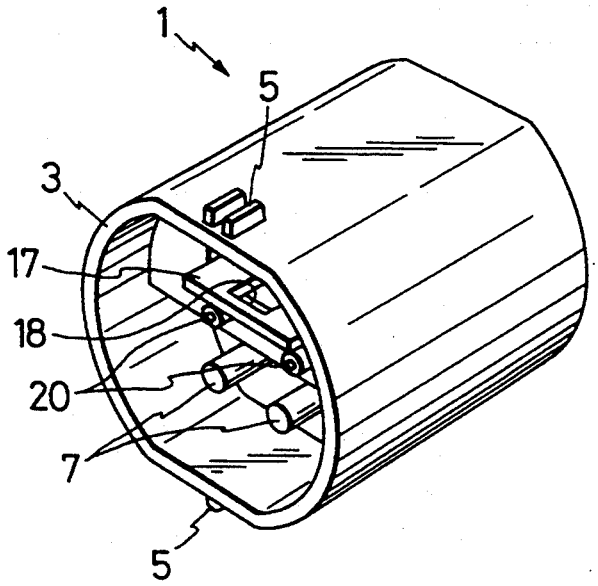
FIGS. 2(A) and 2(B) are a partly-broken, perspective view of the invention.
Figure 2B:
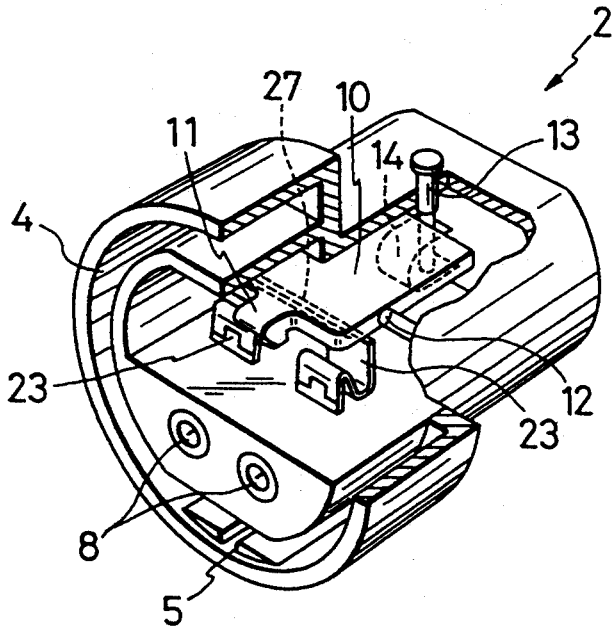

In FIGS. 1 and 2(A) and (B), reference numeral 1 denotes a vehicle-side connector housing, and reference numeral 2 denotes a power source-side housing. A fitting tubular portion 3 is formed at a connection side of the vehicle-side housing 1 at a periphery thereof, and a fitting groove 4 is formed in a connection side of the power source-side housing 2 at a peripheral portion thereof. The fitting tubular portion 3 is fitted into the fitting groove 4 through guides 5 in a predetermined posture, so that they are connected together.

Two male terminals 7, connected to a battery 33 of the electric car, are mounted within the vehicle-side housing I in a projected manner, whereas two female terminals 8, connected to a power source 31 for a battery charger and adapted to respectively receive the male terminals 7 intimately therein, are mounted in a fitted manner within the power source-side housing 2 at positions corresponding respectively to the male terminals.

Within the power source-side housing 2, a lock lever 10 having a retaining pawl 11 at its front end is pivotally supported by a pin 12. A release lever 13, mounted on a body of the housing 2 for upward and downward movement, is connected to a rear end of the lock lever 10. An urging spring 14 of a U-shape urges the release lever 13 upwardly to impart a force to turn the lock lever 10 about the pin 12 in a counterclockwise direction (FIG. 1). With this arrangement, a stopper 15 fitted on the release lever 13 is held against a top wall of the body to limit the upward movement of the release lever 13, thereby limiting the pivotal movement of the lock lever 10, so that the lock lever is normally held in a predetermined posture along the axis of the power source-side housing 2.

Within the vehicle-side housing 1, a lock plate 17, having a fitting hole 18 for receiving the retaining pawl 11, is provided in a projected manner at a position corresponding to the lock lever 10.

When the two housings I and 2 are fitted together, the male terminals 7 are fitted in and connected to the female terminals 8, respectively, and in accordance with this fitting operation, the retaining pawl 11 of the lock lever 10 abuts a front edge of the lock plate 17 and pivotally moves in a clockwise direction against the urging force of spring 14, sliding over the front end of the lock plate. When the housings 1 and 2 are completely fitted together, the lock lever 10 pivotally moves in a counterclockwise direction, so that the retaining pawl 11 is received in the fitting hole 18 in the lock plate 17, thereby locking the two housings in a completely-fitted condition. In the completely-fitted condition, when the release lever 13 is pushed against the urging force of spring 14, the lock lever 10 is pivotally moved in a clockwise direction, so that the retaining pawl 11 is disengaged from the fitting hole 18, thereby releasing the locking engagement so that the two housings 1 and 2 can be disconnected from each other.

The construction of the electrical connection detector will now be described in detail.

Within the vehicle-side housing 1, two first terminals 20 for lock detection purposes are provided beneath the lock plate 17 and are spaced apart from each other. As shown in the circuit diagram of FIG. 3, one of these first terminals is connected to a power source 21 for supplying a detection signal, whereas the other is connected to an input portion of a charge control circuit 22, which is provided in a charging path of the battery 33 of the vehicle so as to control the connection and interruption thereof.

Two second terminals 23 for lock detection purposes are provided beneath the front end portion of the lock lever 10 in the power source-side housing 2 and are spaced apart from each other. Each of the second terminals is formed by bending an electrically-conductive plate. Each of the second terminals 23 has a first contact portion 24 at its one end that can be contacted with a respective one of the first terminals 20. A second contact portion 25 provided at the other end of each second terminal is disposed in facing relation to the lower surface of the front end portion of the lock lever 10.

Affixed to the lower surface of the lock lever 10 is a contact-plate 27 that is contacted with both of the second contact portions 25 of the two second terminals 23 when the lock lever 10 is in its normal posture.

A first opening/closing switch 29 is effected between each first terminal 20 and the first contact portion 24 of a respective one of the second terminals 23, and a second opening/closing switch 30 is effected between the second contact portion 25 of each second terminal 23 and the contact plate 27. With this arrangement, as shown in an equivalent circuit of FIG. 3, there is provided a detection circuit 32 by which the power source 21 for supplying detection current is connected to the charge control circuit 22 via the two first switches 29 and the two second switches 30.

The operation of this embodiment will now be described with reference to FIG. 4.

Figure 4A:
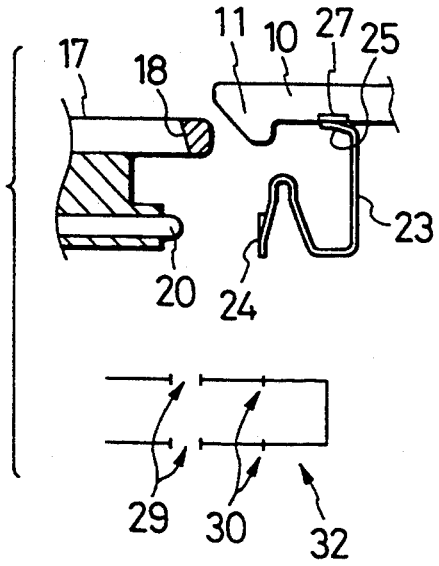
FIG. 4(A) is an explanatory view of the operation of the invention.

As shown in FIG. 4(A), before the two connector housings 1 and 2 are fitted together, the second contact portion 25 of each second terminal 23 is disposed in contact with the contact plate 27, thus keeping the second opening/closing switch 30 in its closed condition, but the first contact portion 24 of the second terminal 23 is spaced apart from the first terminal 20, thus keeping the first opening/closing switch 29 in its open condition. Therefore, the detection circuit 32 is in its open condition.

Figure 4B:
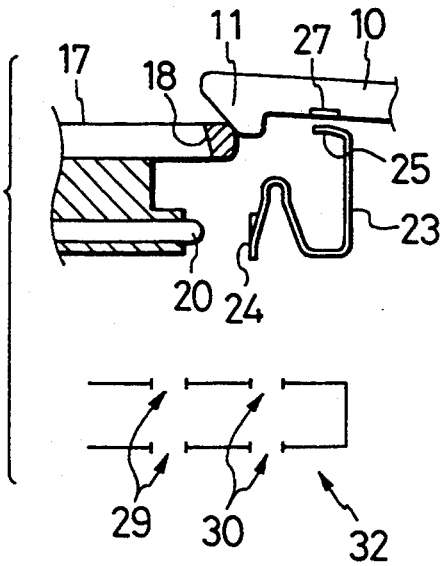
FIG. 4(B) is an explanatory view of the operation of the invention.

When the fitting operation is started, the retaining pawl 11 of the lock lever 10 abuts the front edge of the lock plate 17 before sliding over it, whereupon the contact plate 27 is disengaged from the second contact portions 25 of the second terminals 23, so that the second switches 30 are also opened, as shown in FIG. 4(B), and the detection circuit 32 remains open.

Figure 4C:
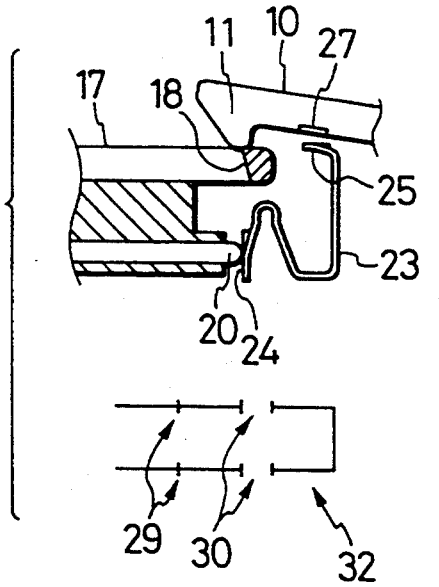
FIG. 4(C) is an explanatory view of the operation of the invention.

When the fitting operation proceeds to a half-fitted condition in which the retaining pawl 11 is about to become received in the fitting hole 18 in the lock plate 17 as shown in FIG. 4(C), the first contact portions 24 of the second terminals 23 respectively contact the first terminals 21 to thereby close the first opening/closing switches 29, but the second opening/closing switches 30 still remain open, and therefore, the detection circuit remains open.

Figure 4D:
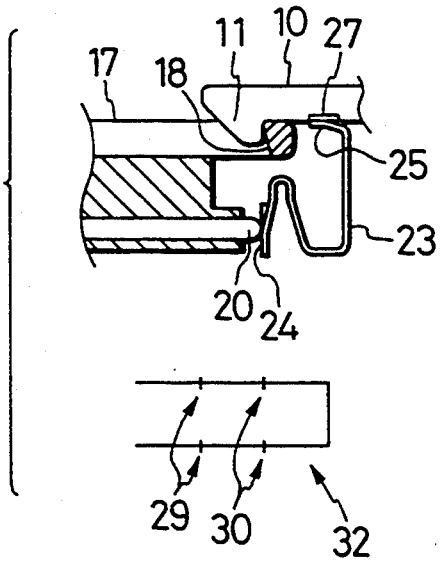
FIG. 4(D) is an explanatory view of the operation of the invention.

When the two housings 1 and 2 are completely fitted together as shown in FIG. 4(D), the lock lever 10 is pivotally returned to its initial position, and the locking pawl 11 becomes fitted in the fitting hole 18 in the lock plate 17, thereby achieving a complete fitting. At this time, the contact plate 27 is brought into contact with the second contact portions 25 of the second terminals 23 to thereby close the second opening/closing switches 30, so that the detection circuit 32 is closed.

Figure 3:
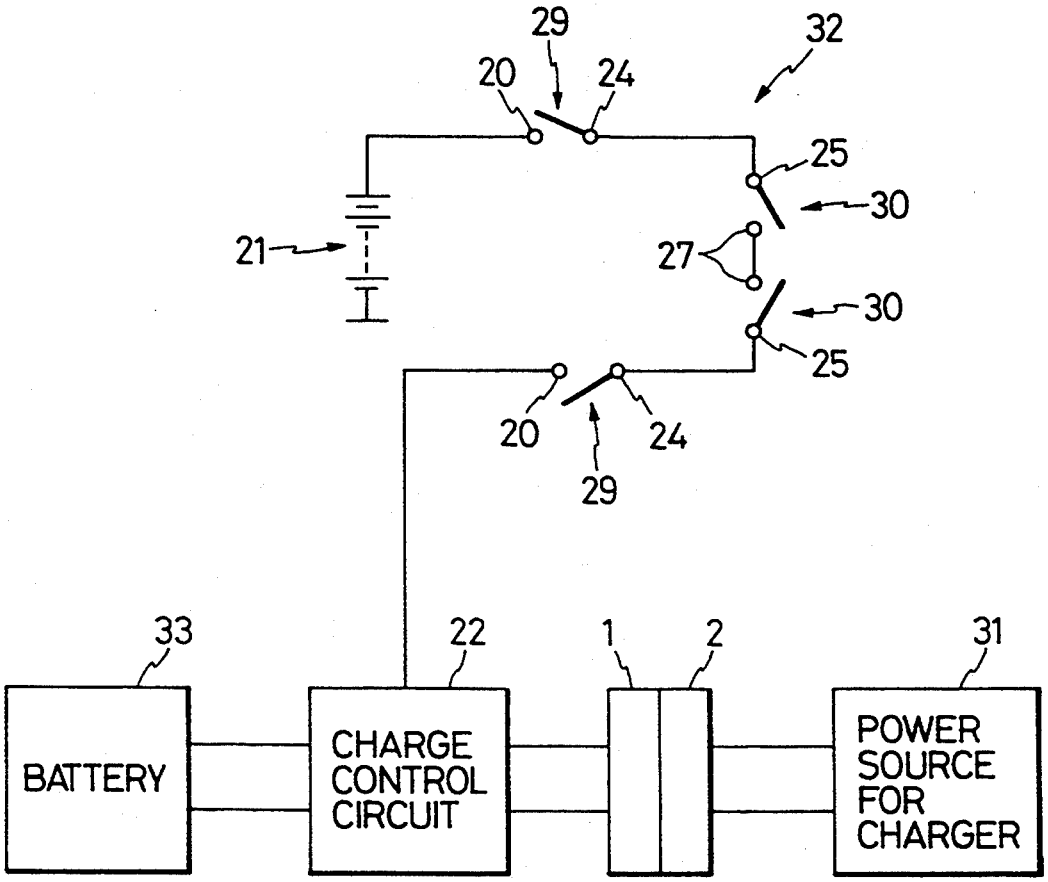
FIG. 3 is a circuit diagram of a detection circuit.

As a result, in FIG. 3, a detection signal is fed to the charge control circuit 22 from the detection signal power source 21, so that the charging path is connected, and the battery of the vehicle can be charged by the power source.

Thus, in this embodiment, when the two housings 1 and 2 are completely fitted together, the detection circuit 32 is closed, thereby enabling charging of the car battery or the like. Furthermore, charging in the half-fitted condition is prevented.

The terminals 20 and 23 and the contact plates 27, constituting the detection circuit 32, are arranged such that the first contact portions 24 of the second terminals 23 are contacted respectively with the first terminals 20 before complete fitting is achieved and such that the contact plate 27 is contacted with the second contact portions 25 of the second terminals 23 when complete fitting is achieved. With this arrangement, high precision is not required for the configuration and mounting position of these parts, and therefore, this construction can be manufactured at relatively low costs.

In addition, there is no risk that a spark is produced between the terminals 20 and 23 and between the terminals 23 and the contact plate 27, and therefore, the detection function can be performed for a long period of time.

In the above embodiment, although the pair of first opening/closing switches 29 and the pair of second opening/closing switches 30 are provided in order to accurately achieve detection of the complete fitting, there may be provided one first opening/closing switch and one second opening/closing switch.

The lock mechanism for locking the housings in the completely-fitted condition is not limited to that of the above embodiment. For example, there may be used a construction in which insertion holes are formed respectively in the two housings 1 and 2 that are aligned with each other only when the completely-fitted condition is achieved, and a plunger is passed through the two insertion holes. In this plunger-type lock mechanism, a contact for contact with the second terminal 23 may be provided on a distal end of the plunger.

The present invention is not limited to the charging connector for an electric car of the above embodiment, and can be applied extensively to all kinds of connectors for achieving other types of electrical connections.

In the present invention, the detection circuit is not closed until the lock means are engaged with each other in accordance with a complete fitting, and therefore, the complete fitting can be easily detected.

Because the detection circuit is closed in accordance with the engagement between the lock means, in contrast with the conventional construction requiring a severe stroke control, the configuration of the terminals and the contact, as well as the mounting positions, does not need to be determined so precisely, and the construction of the invention can be manufactured at low costs.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A connector having a fitting detection function, the connector comprising:

first and second lock members provided respectively within a female connector housing and a male connector housing, said first and second lock members engaging each other when said connector housings are completely fitted together; and at least one terminal disposed within each of said female connector housing and said male connector housing constituting a detection circuit for detecting whether said first and second lock members are engaged with each other, wherein one of said first and second lock members comprises a contact contactable with a corresponding one of said terminals when said connector housings are separated from each other and when said connector housings are completely fitted together, and wherein when said two connector housings are operated to be fitted together, said first and second lock members are engaged with each other after each of said at least one terminal is contacted with each other, said contact contacting said corresponding one of said terminals to close said detection circuit when said connector housings are completely fitted together.

2. A connector comprising:

a male connector housing having a first lock member;

a female connector housing having a second lock member engaging said first lock member when said connector housings are in a completely fitted position;

at least one first terminal disposed in said male connector housing;

a corresponding at least one second terminal disposed in said female connector housing, said corresponding at least one second terminal being electrically engageable with said at least one first terminal;

a contact plate attached to one of said first lock member and said second lock member and electrically engageable with a respective one of said at least one first terminal and said corresponding at least one second terminal when said connector housings are in a separated position and when said connector housings are in said completely fitted position, said at least one first terminal, said corresponding at least one second terminal and said contact plate defining a detection circuit, wherein said detection circuit is closed when said connector housings are in said completely fitted position.

3. A connector housing according to claim 2, comprising two first terminals in said male connector housing and two second terminals in said female connector housing.

4. A connector housing according to claim 2, wherein said contact plate is attached to said second lock member, said contact plate being electrically engageable with said at least one second terminal.

5. A connector housing according to claim 2, wherein one of said first and second lock members comprises a lock lever pivotally supported in a corresponding one of said male connector housing and said female connector housing, said lock lever comprising a retaining pawl at a first end, wherein said retaining pawl is engageable with the other of said first and second lock members.

6. A connector according to claim 5, wherein said lock lever is biased at a second end toward engagement with the other of said first and second lock members.

7. A connector according to claim 6, wherein said lock lever is biased by a spring disposed adjacent said second end of said lock lever.

8. A connector according to claim 7, further comprising a release lever disposed adjacent said second end of said lock lever on an opposite side of said lock lever from said spring, said release lever urging said lock lever to pivot against a force of said spring toward disengagement with the other of said first and second lock members.

9. A connector according to claim 8, wherein the other of said first and second lock members comprises a lock plate having a fitting hole, said fitting hole receiving said retaining pawl.

10. A connector according to claim 9, wherein when said connector housings are in a half-fitted position, said retaining pawl engages said lock plate adjacent said fitting hole, said contact plate being disengaged from said at least one second terminal in said half-fitted position.

11. A connector comprising:

a male connector housing having a first lock member;

a female connector housing having a second lock member engaging said first lock member when said connector housings are in a completely fitted position;

a first terminal disposed in said male connector housing;

a second terminal disposed in said female connector housing and engageable with said first terminal; and means for opening and closing a detection circuit defined by at least said first terminal and said second terminal, said detection circuit being closed by said opening and closing means only in said completely fitted position, wherein said opening and closing means comprises a contact plate fixed to said second lock member, said contact plate engaging said second terminal when said connector housings are in a separated position and when said connector housings are in said completely fitted position.

12. A connector housing according to claim 11, wherein said second lock member comprises a lock lever pivotally supported in said female connector housing, said lock lever comprising a retaining pawl at a first end, wherein said retaining pawl is engageable with said first lock member.

13. A connector according to claim 12, wherein said lock lever is biased at a second end toward engagement with said first lock member.

14. A connector according to claim 13, wherein said lock lever is biased by a spring disposed adjacent said second end of said lock lever.

15. A connector according to claim 14, further comprising a release lever disposed adjacent said second end of said lock lever on an opposite side of said lock lever from said spring, said release lever urging said lock lever to pivot against a force of said spring toward disengagement with said first lock member.

16. A connector according to claim 15, wherein said first lock member comprises a lock plate having a fitting hole, said fitting hole receiving said retaining pawl.

17. A connector according to claim 16, wherein when said connector housings are in a half-fitted position, said retaining pawl engages said lock plate adjacent said fitting hole, said contact plate being disengaged from said at least one second terminal in said half-fitted position.

* * * * *